US010893735B2

(12) United States Patent
Krost

(10) Patent No.: US 10,893,735 B2
(45) Date of Patent: Jan. 19, 2021

(54) HANDS-FREE GROOMING APPARATUS AND METHODS OF USE THEREOF

(71) Applicant: Beard Stencil, Dallas, TX (US)

(72) Inventor: Michael J. Krost, Dallas, TX (US)

(73) Assignee: Beard Stencil, Dallas, TX (US)

( * ) Notice: Subject to any disclaimer, the term of this patent is extended or adjusted under 35 U.S.C. 154(b) by 659 days.

(21) Appl. No.: 15/338,312

(22) Filed: Oct. 28, 2016

(65) Prior Publication Data

US 2017/0119127 A1 May 4, 2017

Related U.S. Application Data

(60) Provisional application No. 62/248,133, filed on Oct. 29, 2015.

(51) Int. Cl.
*A45D 27/42* (2006.01)

(52) U.S. Cl.
CPC ..... *A45D 27/42* (2013.01)

(58) Field of Classification Search
CPC ..... A45D 27/42; A45D 27/38; A45D 27/44; A45D 27/33; A45D 44/22; A45D 44/12; A45D 44/08; A45D 44/002
USPC ..... 132/214
See application file for complete search history.

(56) References Cited

U.S. PATENT DOCUMENTS

| | | | | | |
|---|---|---|---|---|---|
| 815,426 | A * | 3/1906 | Hardee | | |
| 880,718 | A * | 3/1908 | Clendenin | | |
| 955,562 | A * | 5/1909 | Thomas | A61F 13/122 | 128/848 |
| 1,274,636 | A * | 8/1918 | Tucker | A45D 44/22 | 606/204.35 |
| 1,519,915 | A * | 12/1924 | Johnson | A61F 13/122 | 128/848 |
| 2,032,804 | A * | 3/1936 | Jeffery | A45D 44/12 | 604/303 |
| 2009/0223530 | A1* | 9/2009 | Chapman | A45D 27/42 | 132/200 |
| 2011/0308528 | A1* | 12/2011 | Ciardullo | A61F 5/56 | 128/848 |
| 2014/0311512 | A1* | 10/2014 | Owoc | A45D 44/22 | 132/200 |

* cited by examiner

*Primary Examiner* — Rachel R Steitz
*Assistant Examiner* — Brianne E Kalach

(57) ABSTRACT

A hands-free grooming device configured to align with a center point on a user's chin and secure to the user's face via tension created between the user's face when a plurality of tabs are secured to form head and neck straps. Once secured, the grooming device enables the user to perform grooming operations without holding the grooming device in place, resulting in a consistently shaped beard with defined edges.

20 Claims, 10 Drawing Sheets

HANDS-FREE GROOMING APPARATUS AND METHODS OF USE THEREOF

CROSS-REFERENCE TO RELATED APPLICATIONS

This application claims priority to U.S. Provisional Patent Application No. 62/248,133, "System, method, and apparatus for precise and accurate facial hair trimming and shaving," filed Oct. 29, 2015, and incorporated herein in its entirety.

BACKGROUND

Personal grooming may take many forms, including home-based solutions via items purchased from retailers as well as using third parties for services such as those found at spas and salons.

SUMMARY

In an embodiment, grooming device comprising: a first side and a second side; a body comprising an upper boundary, a lower boundary, and a center region, wherein the center region is configured to align with a center point on a chin of a user; a guide edge extending along at least a portion of the lower boundary and configured to promote alignment of the center region with the center point on the chin of the user; a first tab extending outwardly from the upper boundary in a first direction; a second tab extending outwardly from the upper boundary, in a second direction; a third tab extending outwardly from the lower boundary in a third direction; a fourth tab extending outwardly from the lower boundary in a fourth direction wherein the body, the first tab, the second tab, the third tab, and the fourth tab comprise a stretchable material capable of elastic recovery.

In an embodiment, a method of personal grooming comprising: removably coupling, by a user, a first tab of a grooming device and a second tab of a grooming device around a user's neck to form a neck strap; aligning, by the user, a centerline of the grooming device with a center point on a chin of the user; removably coupling, by the user, a third tab of the grooming device and a fourth tab of the grooming device around the user's head to form a head strap; forming, in response to tension generated by the coupling of the first tab and the second tab and by the coupling the third tab and the fourth tab, a secure fit between at least the user's face and a structured component disposed along a bottom edge of the grooming device such that the grooming device is secured in place; and performing a grooming operation on the face of the user subsequent to forming the secure fit, wherein the grooming device remains secured in place during the performing of the grooming operation without the use of additional support.

In an embodiment, a grooming device comprising: a first side and a second side; a body comprising an upper boundary and a lower boundary; a guide edge extending along at least a portion of the lower boundary and configured to promote alignment of a center region with the center point on a chin of a user; a first tab extending outwardly from the upper boundary in a first direction and comprising a coupling region on the first side; a second tab extending outwardly from the upper boundary in a second direction and comprising a coupling region on the second side that is engaged with and coupled to the coupling region of the first tab; a third tab extending outwardly from the lower boundary in a third direction and comprising a coupling region on the first side; a fourth tab extending outwardly from the lower boundary in a fourth direction and comprising comprises a coupling region on the second side that is engaged with the coupling region of the third tab.

BRIEF DESCRIPTION OF THE DRAWINGS

For a detailed description of exemplary embodiments of the invention, reference will now be made to the accompanying drawings in which.

NOTATION AND NOMENCLATURE

Figure 1:
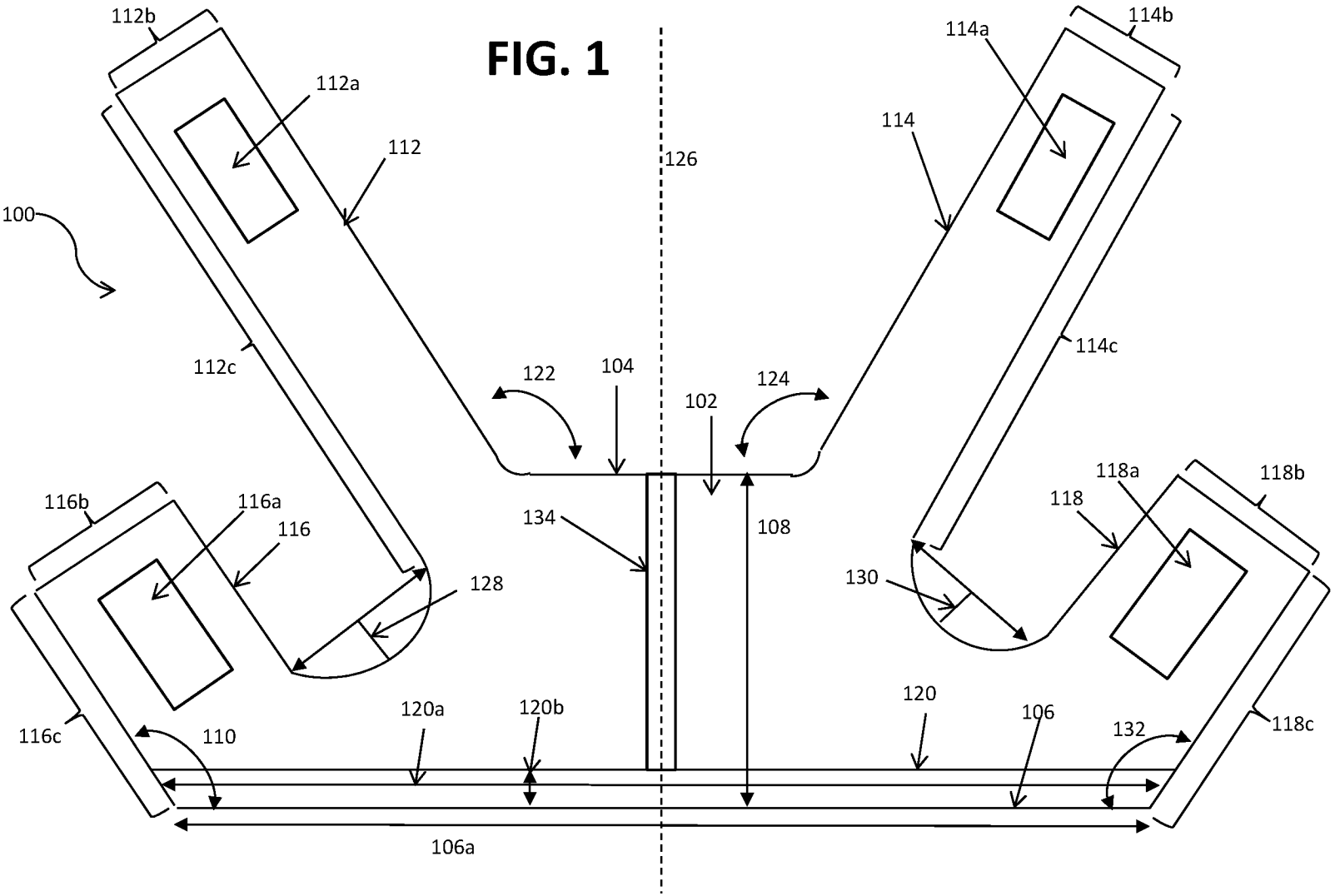
FIG. 1 is a schematic illustration of a front side of grooming template in an unassembled configuration according to certain embodiments of the present disclosure.

Certain terms are employed throughout the following description and claims to refer to particular system components. This document does not intend to distinguish between components that differ in name but not function. In the following discussion and in the claims, the terms "including" and "comprising" are used in an open-ended fashion, and thus should be interpreted to mean "including, but not limited to . . . ." Also, the term "couple" or "couples" is intended to mean either an indirect or direct mechanical connection. Thus, if a first device couples to a second device, that connection may be through a direct mechanical connection, through an indirect mechanical connection via an adhesive layer or other elements or mechanisms. The term "removably coupled" shall mean that two or more components may be coupled and then may be uncoupled one or more times without rendering the components unfit for use.

DETAILED DESCRIPTION

The following discussion is directed to various embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

Various individuals engage in grooming and beauty activities, sometimes visiting barber shops, spas, salons, or other establishments to pay for these services. Some individuals perform personal maintenance at home, for example, by doing at-home manicures and pedicures, dying their hair, cutting their hair including facial hair such as eyebrows and beards. In one example, people who grow beards, sideburns, goatees, soul patches, Van Dykes, or other facial hair may wish to maintain their style of facial hair without paying for salon services. Using the systems and methods discussed herein, facial hair may be styled into precise geometries that may include straight lines across the cheekbones and jawline including the chin. This style may be maintained and/or adjusted reliably and repeatedly using what may be referred to herein as a template to create an impeccably outlined beard with every use.

In an embodiment, the template is made of a material that is stretchable. As used herein, "stretchable" is a term used to describe a material such as spandex, including spandex of type DS-4701 made by Spandex House, Inc., that is capable of being cut to a first set of dimensions and expand to a second set of dimensions in at least one direction, and then subsequently return to its original configuration and the first set of dimensions. The template comprises a body portion with a plurality of straps extending outward from the body. The first set of straps may be referred to as the head straps and the second set of straps may be referred to as the neck straps. The user positions a center of the body with a center point of their chin, and then may attach the neck straps and then the head straps, or the head straps and then the neck straps. The center of the body may be defined by a groove or a cup that is designed to allow for the contour of a user's chin to be securely covered and ultimately secured to the template during use. Both sets of straps may comprise paired locking elements or as mating locking elements or couplers. These couplers may be in the form of hook and loop, adhesives, or combinations of various forms, and the area where these features are located on each strap may be described as coupling regions, since the straps (tabs) may engage and couple via all or part of each coupling region. That is, because the head and neck straps are adjustable, different portions of the coupling regions may engage depending upon the user. Thus, the couplers may be configured to be adjustable so that the template may be used with a plurality of head shapes and so that the head and neck straps may be adjusted to be at a plurality of angles relative to the user's chin once assembled. The portions of the template that are used to form the head and neck straps may be referred to individually as straps and/or tabs and/or extensions interchangeably, to describe features that extend outwardly from the body of the template.

Each of the four straps that comprise the neck and head straps may be expandable during assembly and use and may return, e.g., may elastically recover, to or substantially near its original length subsequent to use. Elastic recovery occurs when, for example, the device is assembled and the straps are stretched from their initial dimensions during assembly, and then return to at or near the original, unassembled dimensions such that the device can be used repeatedly without compromising the integrity of the structure of the device or its use as a grooming tool.

In an embodiment, the stretchable material may be capable of elastic recovery by expanding from between 50% to about 200% in multiple directions, including the length of the head and neck straps. In some embodiments, each head strap may extend from about 3 inches to about 6 inches from the body when in an unassembled state, and each neck strap may extend from about 1 inch to about 4 inches from the body, also when in an unassembled state. In an embodiment, the body may extend between the tabs from about 4 inches to about 8 inches in an unassembled state. The template is washable in part to enable its use with various shaving aids such as soaps, shaving cream, shaving gels, dyes, and other products, and is also able to undergo a drying process in ambient air or heated air without losing its elastic recovery properties. In some embodiments, more than one type of stretchable (elastic) material may be used to form the body, the head straps, and the neck straps, and the various materials may comprise different elastic values, that is, the different materials may be capable of stretching and recovering to different extents.

In some embodiments, the template comprises a rolled or otherwise structured portion that extends along the bottom edge of the body. This structured portion acts to create and may be referred to as a guide edge; the guide edge creates a smooth grooming line in addition to helping secure the template to the user's face. The tension created by assembly and the stretchable material capable of elastic recovery may be said to form a seal with the user's face once secured to the lower portion of a user's chin, neck, and jawline, securing the template to the user. This guide edge promotes multiple functionalities including creating a guiding line for grooming processes, e.g., an edge along which to guide a razor, and helps holds the template in place by securing the template to the face so that it does not move during wet or dry operations that may involve sharp tools such as razors and scissors. The structured portion may comprise the same material as the body, but may be rolled or otherwise sewn to comprise a greater thickness and stiffness than the body material. In alternate embodiments, the structured portion may comprise a material that is not the same as the material used to form the body and straps, and may be coupled to the body via mechanical, thermal, or a combination of mechanisms. The stretchable (elastic) nature of the template material or materials, in combination with the head straps, neck straps, and structured portion of the body act to create tension against the user's face, neck, and head to create this guide edge for grooming and secure the template in place for hands-free grooming, including shaving and trimming. Once secured to a user, the template is held in place through operations such as wet or dry shaving or trimming, dyeing, or other operations. Once removed from the user's face, the template elastically recovers and returns to its original dimensions when in the unassembled state.

Different embodiments of the template may comprise different body designs, including tapering some or all of the edges of the body in order to produce differently shaped beards, goatees, sideburns, or other facial hair features. In some embodiments, this may mean that the body is not a single solid piece, but rather may comprise cut outs, which may be removable or modular with the structure, as well as additional guide edge regions similar to those described herein that comprise reinforced materials or materials that otherwise compress a rigidity sufficient to promote securing the device to the user's face. In one example, the body may comprise a seam that may be centered or off-center, and in another example the body may comprise a contiguous piece with no seams or with no visible seams. In yet another example, the body may comprise multiple pieces joined together to promote a secure fit via tension when assembled, as described in detail herein.

In some embodiments, the head and neck straps may each comprise a consistent width as the straps extend outward from the body. In alternate embodiments the head straps, the neck straps, or both, may be tapered such that the width of the strap increases or decreases along the length of the strap that extends outward from the body. Both the head and neck straps may comprise different lengths depending upon the embodiment. In one example, both head straps are of equal length, and in another example, one head strap is longer than the other and the template secures itself on the side of the head, instead of in the back of the head approximately 180 degrees from the user's chin as may be the case in some embodiments.

FIG. 1 is a schematic illustration of an embodiment of a grooming template 100 in an unassembled configuration. The grooming template 100 comprises a body 102 defined by an upper boundary 104 and a lower boundary 106 and a width 108. The lower boundary may be defined in part by a width 106*a* that may vary depending upon the state of the grooming template 100 as it is made from a stretchable material capable of expanding up to 200% of its original dimensions in at least one direction and capable of elastically recovering after use and after multiple washing and drying cycles. A first tab 112 extends outward from the body 102 at an angle 122 from the upper boundary 104 of the body 102. A second tab 114 extends outward from the body 102 at an angle 124 from the upper boundary 104 of the body 102, the absolute values of the angles 122 and 124 may be the same, and an axis 126 may be described as a mirroring axis. That is, the features on either side of the axis 126 may be mirrored across the axis with respect to length, width, angle, and thickness. In some embodiments, the angles 122 and 124 may indicate smooth transition surfaces from the upper boundary 104 to the respective tabs 112 and 114. The grooming template 100 may stretch along the axis 126, in directions perpendicular to the axis 126, as well as in other directions and in multiple directions simultaneously, for example, while the body 102 is contouring around the chin during assembly. When the grooming template 100 is removed from the user's face, the stretchable material elastically recovers to its unassembled dimensions.

In an embodiment, the first tab 112 may comprise a width 112*b* and a length 112*c*, and may comprise a coupling region 112*a* on either the first or the second sides of the grooming template 100. The region of the first tab 112 that includes the coupling region 112*a* may vary, that is, the dimensions of the coupling region 112*a* may vary. The second tab 114 may comprise a width 114*b* and a length 114*c*, and may comprise a coupling region 114*a* on either the first or the second sides of the grooming template 100. The region of the first tab 114 that includes the coupling region 114*a* may vary, that is, the dimensions of the coupling region 114*a* may vary. In an embodiment, if the coupling region 112*a* is disposed on the first side of the grooming template 100, then the coupling region 114*a* is disposed on the second side of the grooming template 100. Similarly, in an alternate embodiment, if the coupling region 112*a* is disposed on the second side of the grooming template 100, then the coupling region 114*a* is disposed on the first side of the grooming template 100. In some embodiments, one or both of the first and second tabs 112 and 114 may comprise coupling regions 112*a* and 114*a* on both the first and the second sides of the grooming template 100.

In an embodiment, a third tab 116 extends outward from the body 102 at an angle 110 relative to the lower boundary 106 of the body 102. A fourth tab 118 extends outward from the body 102 at an angle 132 relative to the lower boundary 106 of the body 102, the absolute values of the angles 110 and 132 may be the same. The third tab 116 may comprise a width 116*b* and a length 116*c*, and may comprise a coupling region 116*a* on either the first or the second sides of the grooming template 100. The region of the third tab 116 that includes the coupling region 116*a* may vary, that is, the dimensions of the coupling region 116*a* may vary. The fourth tab 118 may comprise a width 118*b* and a length 118*c*, and may comprise a coupling region 118*a* on either the first or the second sides of the grooming template 100. The region of the third tab 116*a* that includes the coupling region 116*a* may vary, that is, the dimensions of the coupling region 116*a* may vary. In an embodiment, if the coupling region 116*a* is disposed on the first side of the grooming template 100, then the coupling region 118*a* is disposed on the second side of the grooming template 100. Similarly, in an alternate embodiment, if the coupling region 116*a* is disposed on the second side of the grooming template 100, then the coupling region 118*a* is disposed on the first side of the grooming template 100. In some embodiments, one or both of the third 116 and fourth 118 tabs may comprise coupling region 116*a* and 118*a* on both the first and the second sides of the grooming template 100.

The first 112 and third 116 tabs may be separated by and transitioned between via a smooth transition surface indicated by a radius of curvature 128, and the second 114 and fourth 118 tables may be separated by a radius of curvature 130. Referring back to the mirror axis 126, the radii 128 and 130 may be the same or similar values.

The coupling regions 112*a*, 114*a*, 116*a*, and 118*a* may comprise various elements including hook-and-loop, adhesive, magnets, and combinations thereof of various elements sufficient to hold the grooming template 100 in place under the tension created when the first 112 and second 114 tabs are secured via the coupling regions 112*a* and 114*a* and when the second 116 and third 118 tabs are secured via the coupling regions 116*a* and 118*a*. These coupling regions may differ in size, shape, and material among and between the coupling regions 112*a*, 114*a*, 116*a*, and 118*a*.

In an embodiment, the grooming template 100 comprises a groove 134 or a center portion 134 that extends from the upper boundary 104 of the body 102 to a guide edge 120 that may be referred to as a bumper 120. In different embodiments, the body 102 may comprise more than one guide edge 120, for example, located along the upper boundary 104 of the body 102 or along cut-outs (not shown) in the body 102, or on some or all edges of the tabs 112, 114, 116, and 118. The center portion 134, which may also be referred to as a center contour, alignment portion, or center alignment portion, is shown in 2-dimensions in FIG. 1. In various embodiments, the center portion 134 may be in the form of a seam and/or material geometry that forms a cup to hold/promote formation/contouring of the grooming template 100 to the chin of the user when the grooming template 100 is secured to the user's face. The guide edge 120 comprises a length 120*a* and a width 120*b*, as well as a thickness (not shown) that may be greater than the thickness of the device body and at least a portion of the tabs 112, 114, 116, 118, e.g., the portion of the tabs where material for the couplers (referred to herein as the coupling regions) is not disposed. The guide edge 120 acts as a guide for a razor and forms, in conjunction with the tension created via the stretchable material of the grooming template 100, a secure fit between the user's face to enable hands-free grooming once the tabs 112/114 and 116/118 are coupled which creates the tension. The guide edge 120 may comprise, for example, elasticized satin or rubber or another material that is still stretchable but more rigid and in some instances thicker than the stretchable material comprising other elements of the grooming template 100. Since grooming operations using mounted and straight razors as well as other sharp implements are potentially dangerous to the user, having both hands free to manipulate the grooming tool(s) enhances the safety factor of grooming when the template is in use.

Figure 2:
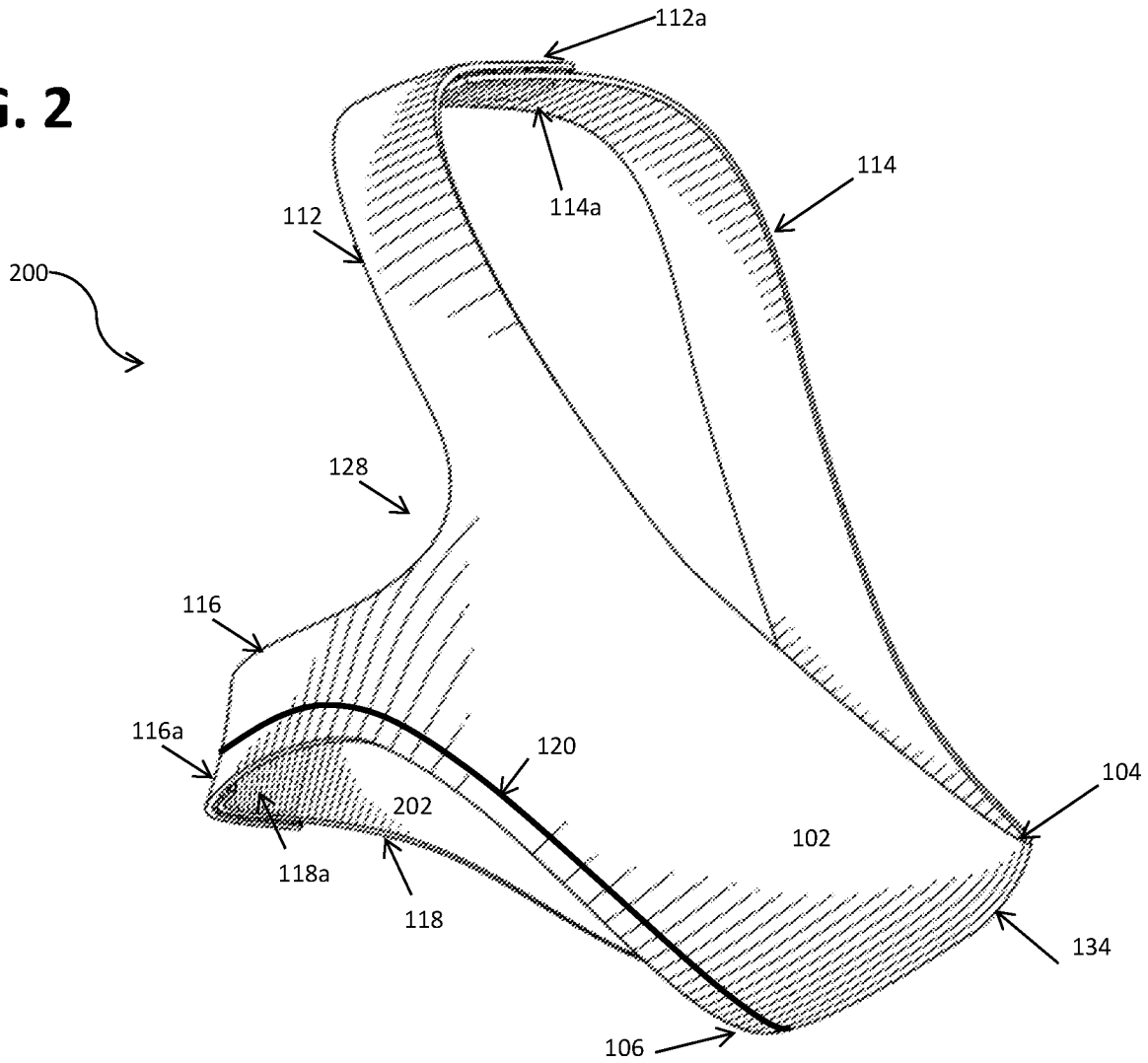
FIG. 2 is a perspective view of a grooming template in an assembled configuration according to certain embodiments of the present disclosure.
Figure 3:
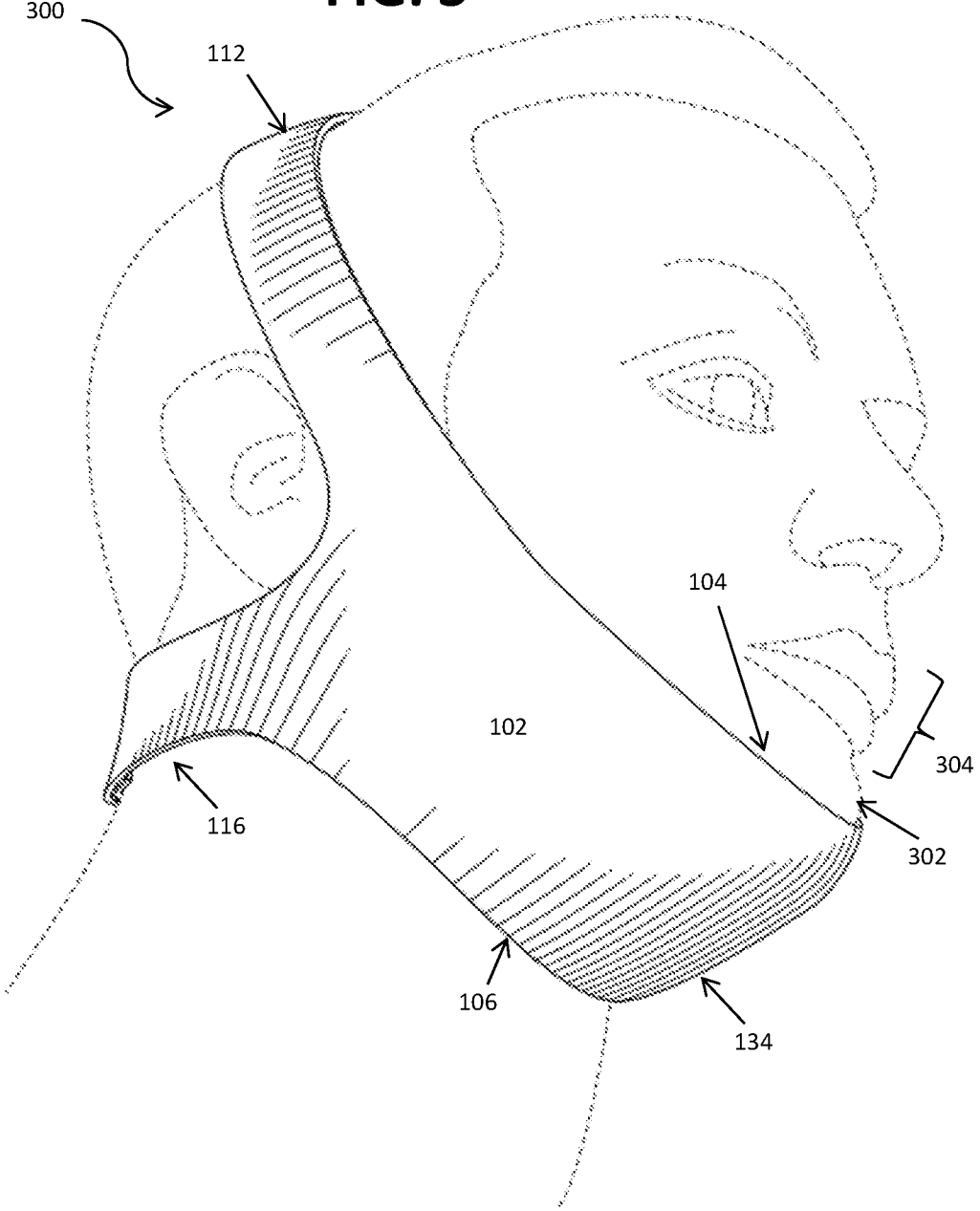
FIG. 3 is a perspective view of a grooming template in an assembled configuration on a user according to certain embodiments of the present disclosure.

Since the grooming template 100 is formed from stretchable material capable of elastic recovery, the example angles discussed above may vary, and the lengths 112*c*, 114*c*, 116*c*, and 118*c* may each comprise a first value as shown in FIG. 1 in an unassembled state and may each comprise a second value that is greater than the first value when the grooming template 100 is in an assembled state as shown in FIGS. 2 and 3 and discussed below. When the grooming template 100 is removed from the user's face, the dimensions return to or near the first values when the template is in the unassembled configuration of FIG. 1. It is appreciated that the dimensions and relative positions illustrated in FIG. 1 are examples, and that, given the various dimensions and shapes of human faces in combination with the stretchable material used for the grooming template 100 to create tension when it is assembled, those dimensions and relative positions (angles) may vary according to embodiments that may produce different beard patterns and may be usable for faces and beards of various sizes and shapes. In an embodiment, and as further illustrated in the figures discussed below, the first 112 and second 114 tabs may be referred to as portions of a head strap and the third 116 and fourth 118 tabs may be referred to as portions of a neck strap.

FIG. 2 is a perspective view of an embodiment of a grooming template 200 in an assembled configuration according to certain embodiments of the present disclosure. FIG. 2 illustrates the grooming template 200 in the assembled configuration wherein the first tab 112 is coupled to the second tab 114 via the respective coupling regions 112*a* and 114*a* to form a head strap. Also shown is the radius of curvature 128, illustrated with an arrow that may be a different value than in the unassembled configuration. The center portion 134 is illustrated as forming a cup for the chin (shown in FIG. 3), the body 102 and the upper 104 and lower 106 boundaries of the body 102 are also illustrated in the assembled configuration of the grooming template 200. FIG. 2 also illustrates a portion of the guide edge 120, it is appreciated that this component is present on embodiments of the grooming template 200 in the various views and figures presented herein, and may or may not be visible to the naked eye when the template is unassembled or assembled. The back side 202 of the fourth tab 118 is also visible in FIG. 2.

FIG. 3 is a perspective view of an embodiment of a grooming template 300 in an assembled configuration on a user according to certain embodiments of the present disclosure. As shown in FIG. 3, the center portion 134 is aligned with the center point 302 of the chin, and the upper boundary 104 of the body 102 does not extend into the region 304 of the user's lips. In alternate embodiments, the body 102 may include a portion that extends above the lips (not shown), for example, if the user desires to maintain a moustache. The first tab 112 stretches to extend around the user's ear, and the third tab 116 also stretches to extend below the user's ears and around a portion of their neck. While the upper boundary 104 is illustrated in a first position with respect to the user's chin in FIG. 3, in alternate embodiments, the upper boundary 104 may extend further towards the lip region 304 without overlapping it, or may extend away from the lip region 304, for example, if the user is targeting a goatee style.

Figure 4:
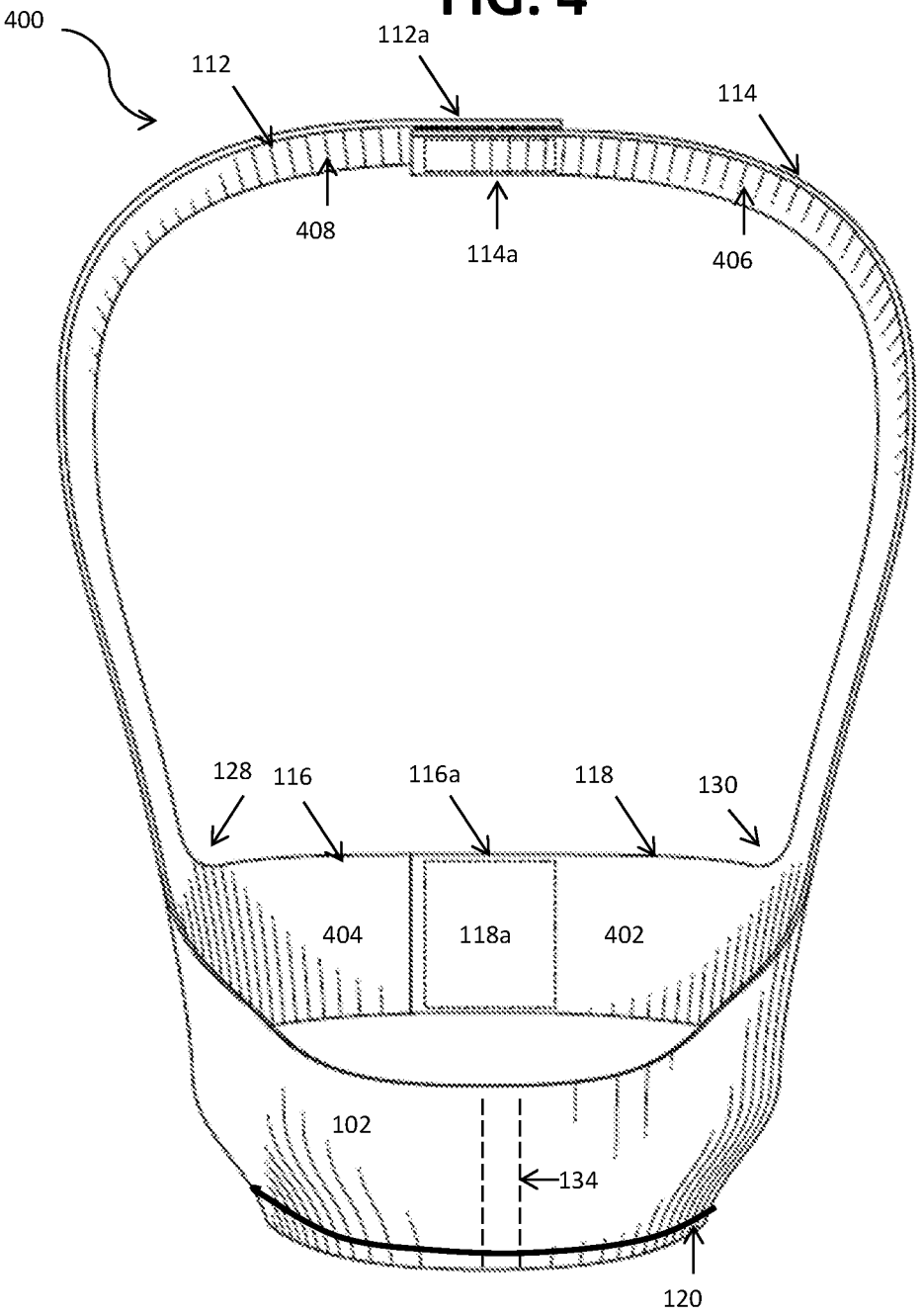
FIG. 4 is a front view of a grooming template in an assembled configuration according to certain embodiments of the present disclosure.

FIG. 4 is a front view of an embodiment of a grooming template 400 in an assembled configuration on a user according to certain embodiments of the present disclosure. FIG. 4 illustrates the back side 402 of the fourth tab 118 and the back side 404 of the third tab 116 when the tabs are coupled together and secured via the third 116*a* and fourth 118*a* coupling regions. FIG. 4 additionally illustrates the back side 406 of the second tab 114 and the back side 408 of the first tab 112 when the tabs are coupled together and secured via the first 112*a* and the second 114*a* coupling regions. It is appreciated that, depending upon the embodiment, different portions, e.g., all of the regions or portions of that comprise less than all of the regions 112*a*/114*a* and 116*a*/118*a* may be engaged during use.

Figure 5:
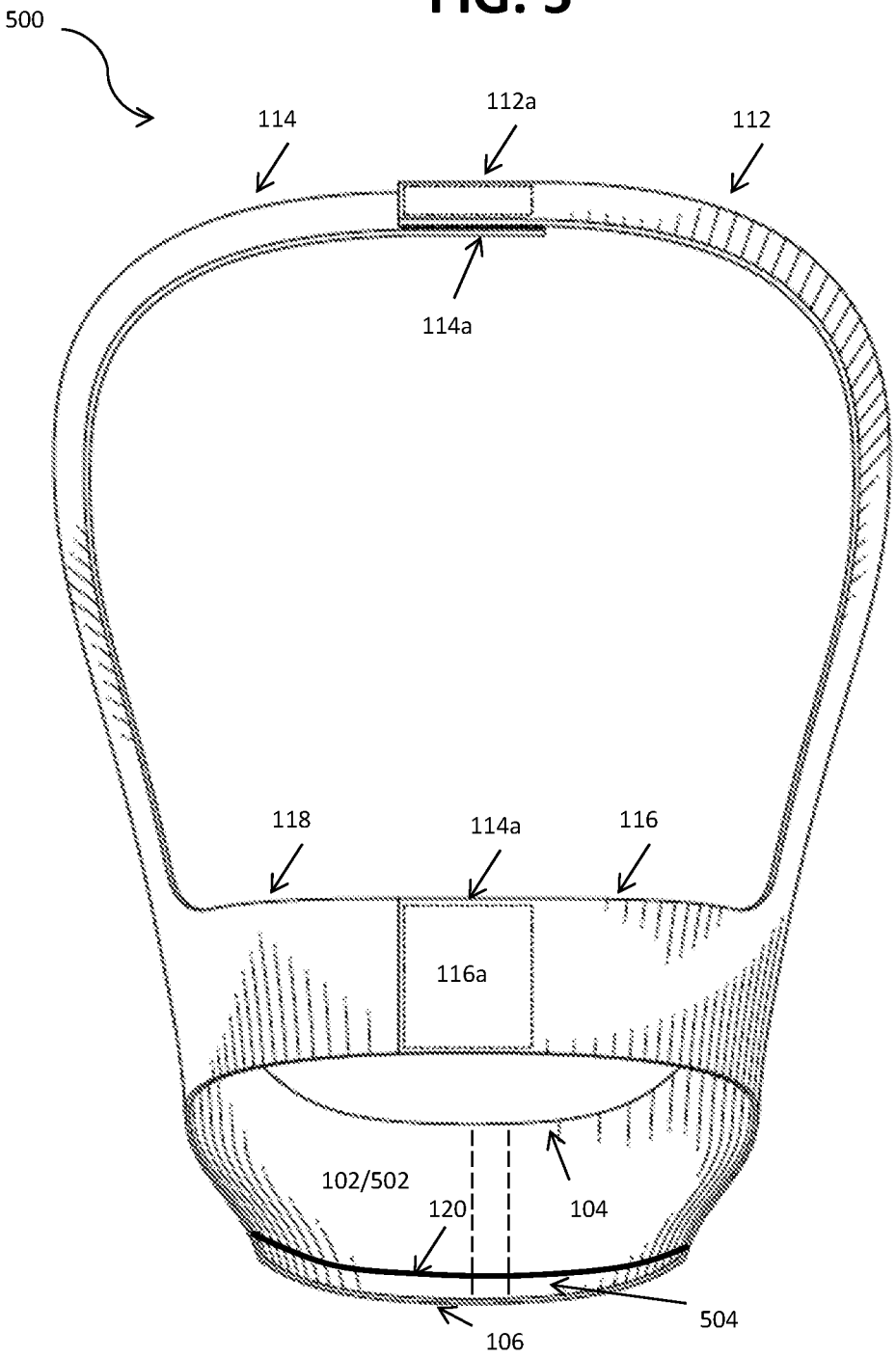
FIG. 5 is a back view of a grooming template in an assembled configuration according to certain embodiments of the present disclosure.

FIG. 5 is a back view of an embodiment of a grooming template 500 in an assembled configuration on a user according to certain embodiments of the present disclosure. FIG. 5 shows the back side 502 of the body 102. The guide edge 120 is illustrated in both FIGS. 4 and 5 because the feature may be visible to the eye on one or both sides of the template 400/500. In alternate embodiments, it may not present as visible. The guide edge 120 may comprise the same or a different stretchable material as compared to the template, in some embodiments it may comprise layered material, and in other embodiments (not illustrated) there may be an adhesive material, a polymer material, a textile, or another material on the back side 504 of the guide edge 120 to further enhance the tension that promotes the fit of the template to the face and thus the hands-free functionality of the template. Even though the back side 504 of the guide edge 120 may be considered the primary functional side, because the guide edge 120 may comprise a greater thickness than the rest of the template, it may be visible from both the front view in FIG. 4 and the back view in FIG. 5.

Figure 6:
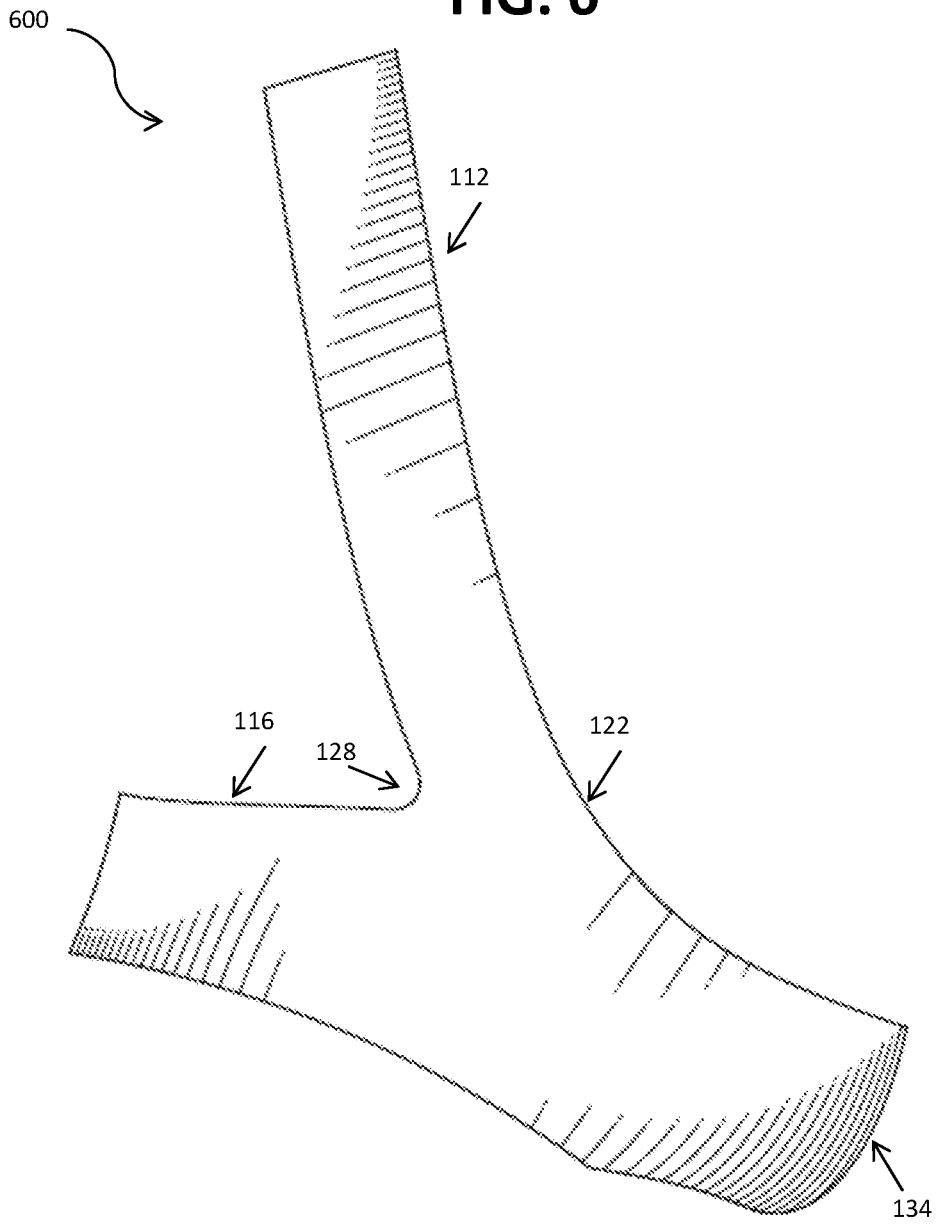
FIG. 6 is a first side view of a grooming template in an assembled configuration according to certain embodiments of the present disclosure.

FIG. 6 is a first side view of a grooming template 600 in an assembled configuration according to certain embodiments of the present disclosure.

Figure 7:
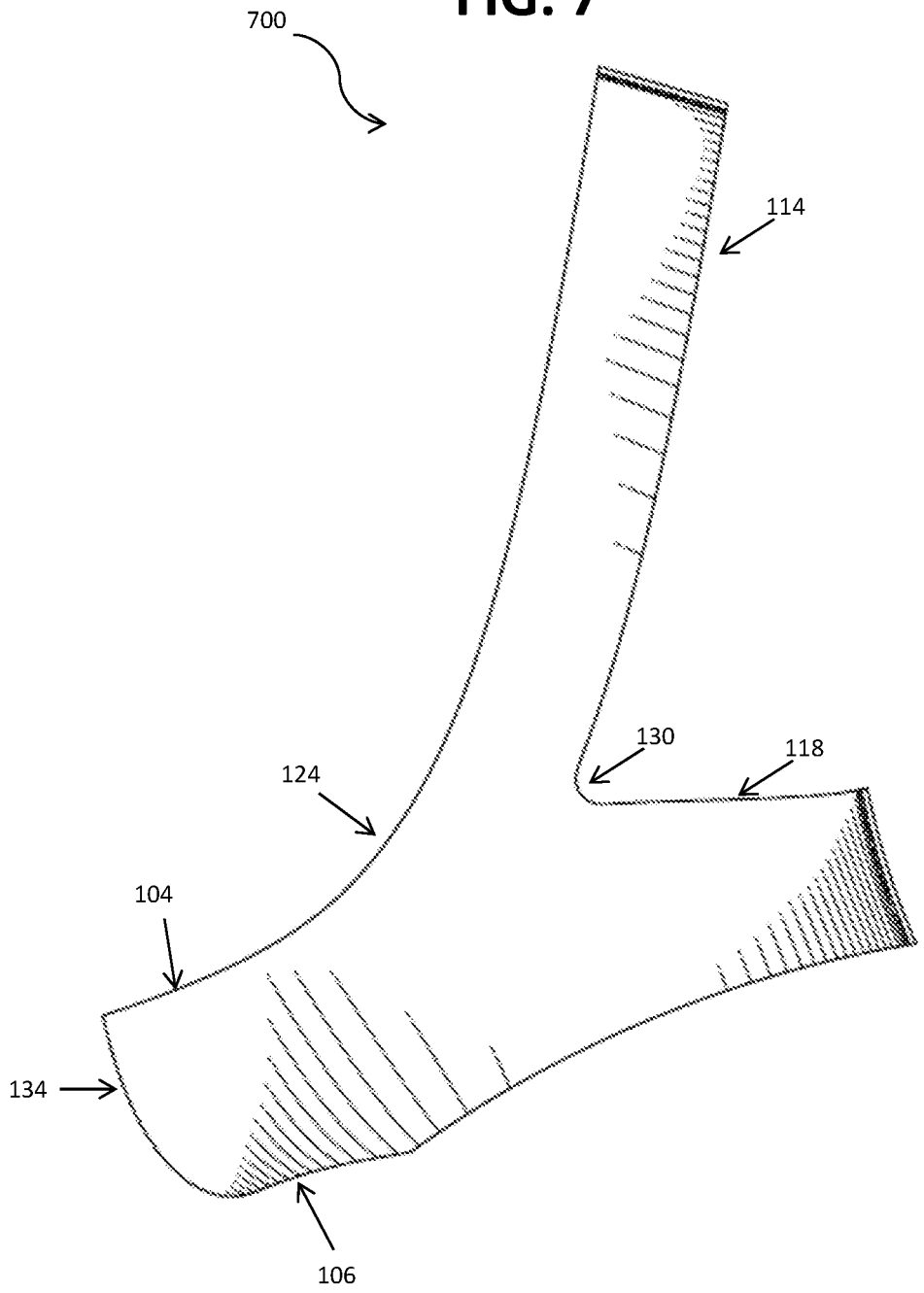
FIG. 7 is a second side view of a grooming template in an assembled configuration according to certain embodiments of the present disclosure.

FIG. 7 is a second side view of a grooming template 700 in an assembled configuration according to certain embodiments of the present disclosure.

Figure 8:
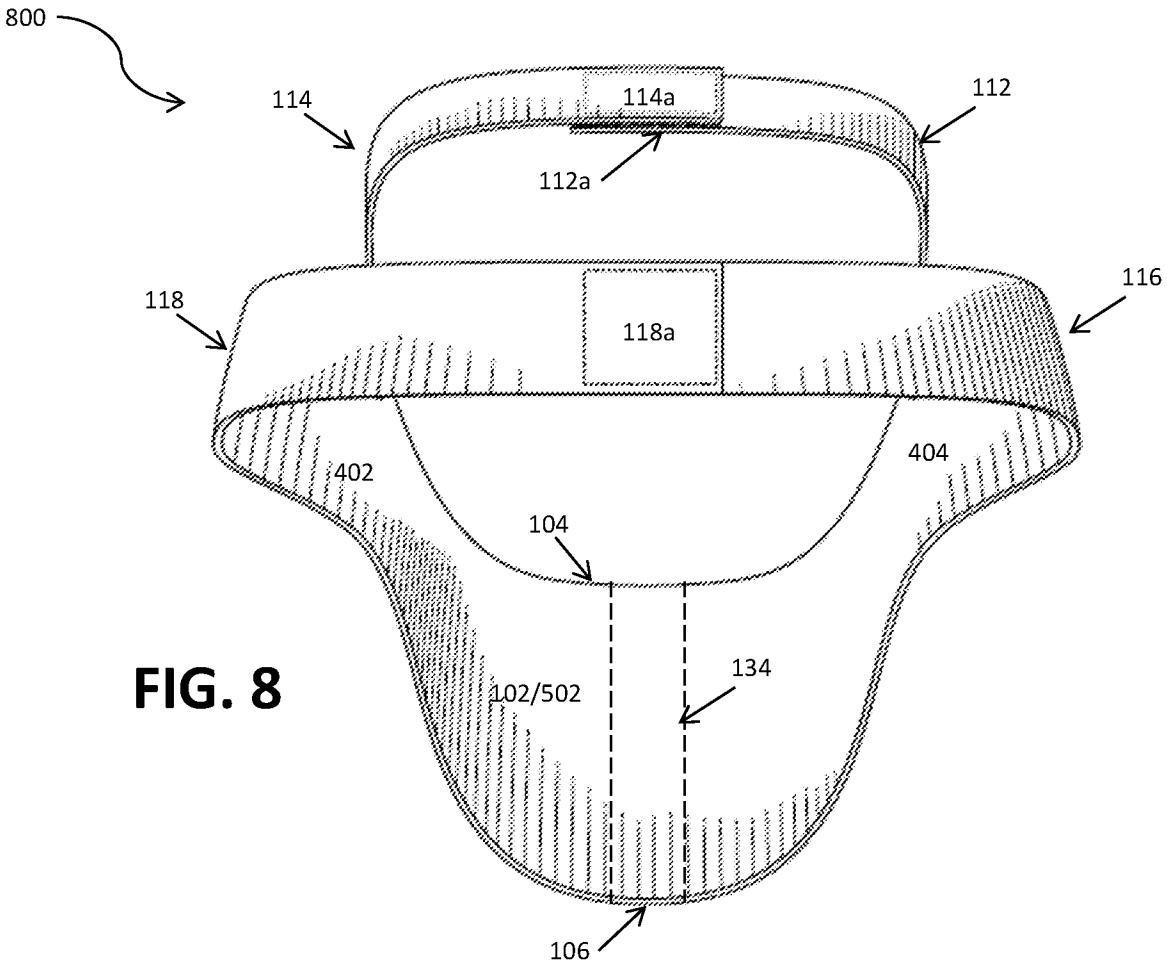
FIG. 8 is a top-down view of a grooming template in an assembled configuration according to certain embodiments of the present disclosure.

FIG. 8 is top-down view from the back of a grooming template 800 looking down towards back side 502 the body 102 in an assembled configuration according to certain embodiments of the present disclosure.

Figure 9:
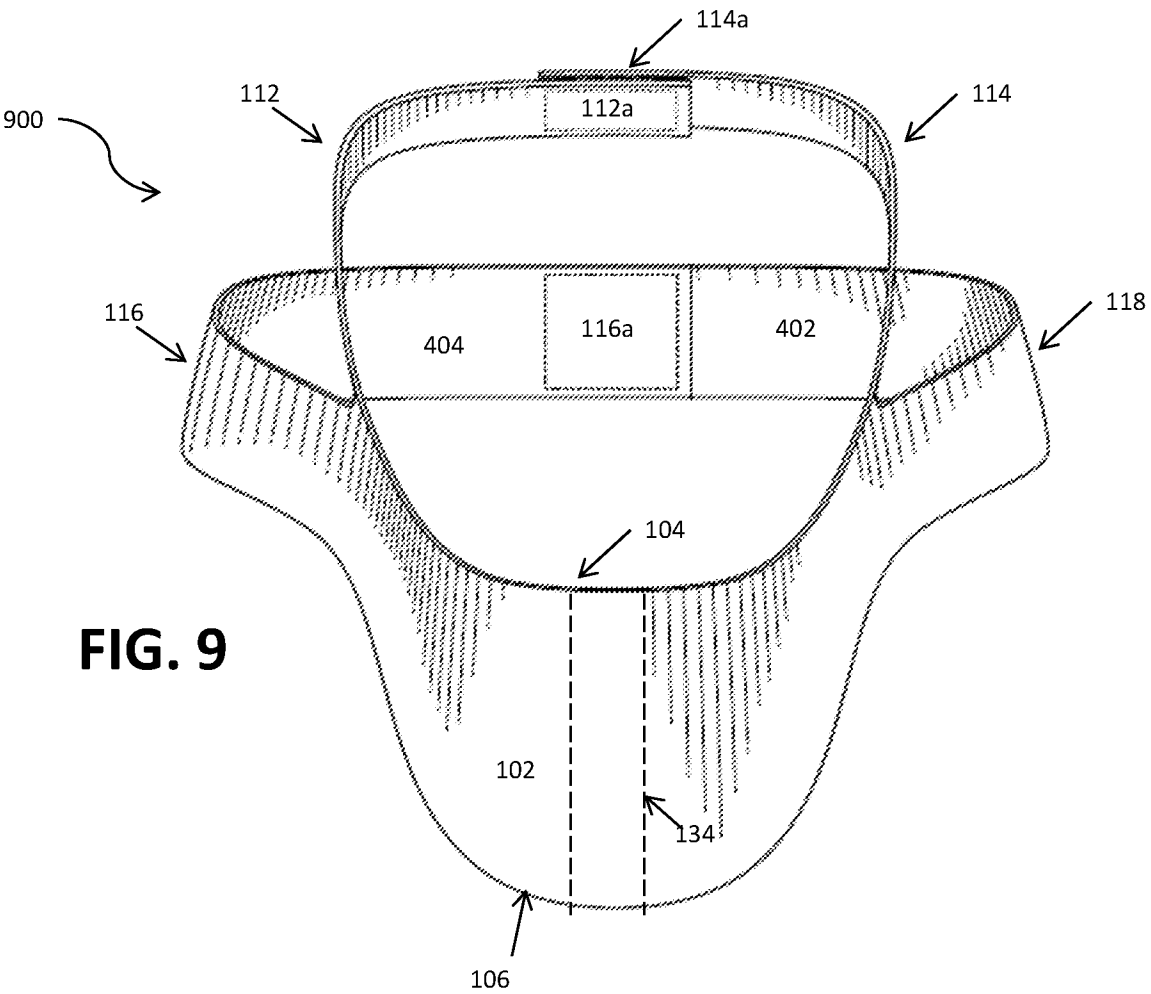
FIG. 9 is a bottom-up view from the front of a grooming template in an assembled configuration according to certain embodiments of the present disclosure.

FIG. 9 is bottom-up view of a grooming template 900 looking up towards back side 402 of the second tab 114 and the back side 404 of the first tab 112 in an assembled configuration on a user according to certain embodiments of the present disclosure.

Figure 10:
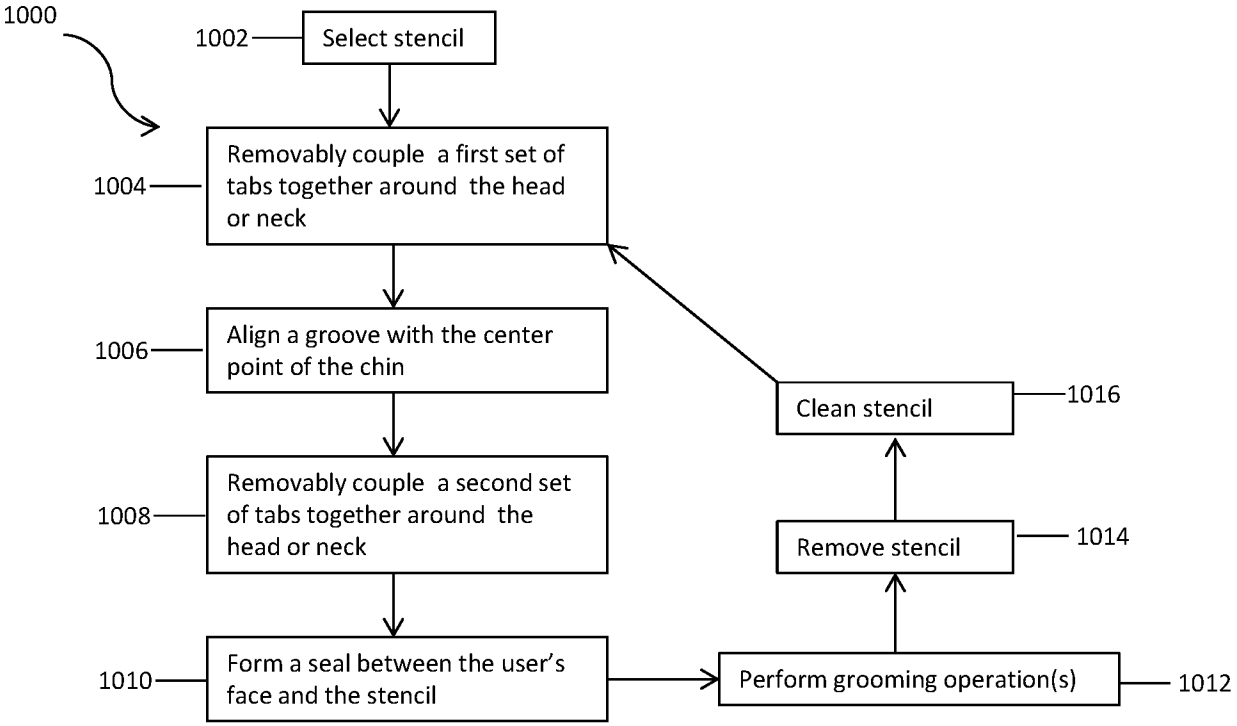
FIG. 10 is a method of use of a grooming template in an assembled configuration according to certain embodiments of the present disclosure.

FIG. 10 is a method 1000 of use of a grooming template in an assembled configuration on a user according to certain embodiments of the present disclosure. At block 1002 of the method 1000, a user selects a template to use. This selection may be based upon the shape of the user's face and/or the desired beard pattern, and/or the type of grooming operation intended. At block 1004, a first set of tabs may be removably coupled together around either the user's head or neck prior to the user aligning a groove with the center point of their chin at block 1006. The groove discussed herein is referenced above as center portion 134, and refers to the part of the template body designed to contour to at least the user's chin. In some embodiments, the tabs removably coupled at block 1004 may be coupled to form the head strap, and in alternate embodiments the tabs removably coupled at block 1004 be coupled to form the neck strap. At block 1008, the tabs that were not assembled at block 1004 are assembled, the assembly of which promotes formation of a secure fit between the template and the user at block 1010 based on the stretchability (elastic recovery property) of the material and the tension created by assembly. Once assembled, the template is secured to the user's face, thus promoting and enabling hands-free use of the template during grooming operations at block 1012. This grooming operation or operations at block 1012 may use wet or dry razors or in some cases dyes or bleaches. Thus, the grooming operations are performed without the use of additional support such as the user's hands or a third party's assistance.

The template enables the user at block 1012 to perform grooming operations by acting as a guide for the razor or other device around the neckline as well as the other boundaries of the template. The template, once assembled and secured to the user's face at block 1010 to form a guide edge for razors and other grooming tools, has been positioned as to leave portions of existing hair growth exposed for removal and to cover portions of existing hair growth that the user wishes to preserve. In some embodiments, the guide edge may serve as a barrier to soap, shaving cream, gels, and other grooming products and prevent those products from being distributed on the covered portions of a user's face. At block 1014, subsequent to performing the grooming operation or operations at block 1012, the template is removed by uncoupling the head and the neck strap. In various embodiments, the head strap may be uncoupled before the neck strap, and in alternate embodiments, the neck strap may be uncoupled first. When the template is removed, the user can see the shaped facial hair that comprises clean, smooth lines as defined by the template's previous position on the user as defined in at least the alignment at block 1006. At block 1016, the template may be cleaned using water, soap, or other cleaning agents in order to be reused, and the method may begin again at block 1004 when the same template is selected.

The above discussion is meant to be illustrative of the principles and various embodiments of the present invention. Numerous variations and modifications will become apparent to those skilled in the art once the above disclosure is fully appreciated. It is intended that the following claims be interpreted to embrace all such variations and modifications.

What is claimed is:

1. A method of personal grooming comprising:

removably coupling, by a user, a first tab of a grooming device and a second tab of a grooming device around a user's neck to form a neck strap;

aligning, by the user, a centerline of a body of the grooming device with a center point on a chin of the user, wherein the body is formed from a stretchable material;

removably coupling, by the user, a third tab of the grooming device and a fourth tab of the grooming device around the user's head to form a head strap;

forming, in response to tension generated by the coupling of the first tab and the second tab, the coupling of the third tab and the fourth tab, and the stretchable material of the body, a seal between at least the user's face and a guide edge disposed along a bottom edge of the grooming device such that the grooming device is secured in place, wherein the guide edge is formed on and extends between the first tab and the second tab along a bottom edge of a lower boundary of the body, wherein the guide edge is a structured component comprised of a material that is more rigid than the stretchable material from which the body is formed, wherein the material of the guide edge is different than the stretchable material from which the body is formed;

performing a grooming operation on the face of the user subsequent to forming the seal, wherein the grooming operation comprises hair removal, shaving, trimming, or combinations thereof; and using the guide edge on the bottom edge of the grooming device as a contact guide for a grooming tool while performing the grooming operation.

2. The method of claim 1, further comprising:

removing the grooming device from the user via:

uncoupling, by the user, subsequent to performing the grooming operation, the first tab and the second tab; and uncoupling, by the user, subsequent to performing the grooming operation, the third tab and the fourth tab;

wherein the uncoupling of the first tab and the second tab and the uncoupling of the third tab and the fourth tab releases the secure fit formed between the grooming device and the user's face.

3. The method of claim 2, further comprising cleaning, subsequent to performing the grooming operation, the grooming device prior to a subsequent use.

4. The method of claim 3, wherein cleaning comprises using at least one of water or detergent.

5. The method of claim 2, wherein the grooming operation further comprises dyeing.

6. The method of claim 2, wherein the guide edge inhibits movement of the grooming device subsequent to the removable coupling of the first tab and the second tab and the removable coupling of the third tab and the fourth tab.

7. The method of claim 1, further comprising: preventing at least one of soap, shaving cream, or a gel from contacting the portion of the user's face covered by the guide edge and body based on the seal between at least the user's face and the guide edge.

8. The method of claim 1, wherein the guide edge inhibits movement of the grooming device subsequent to the removable coupling of the first tab and the second tab and the removable coupling of the third tab and the fourth tab.

9. The method of claim 1, further comprising an material disposed on at least a portion of at least one side of the guide edge, wherein the material comprises at least one of: an adhesive material or a polymer material.

10. A method of shaving with a grooming device, the method comprising:

removably coupling, by a user, a first tab of a grooming device and a second tab of a grooming device around a user's neck to form a neck strap;

removably coupling, by the user, a third tab of the grooming device and a fourth tab of the grooming device around the user's head to form a head strap, wherein the grooming device comprises a body formed from a stretchable material, wherein the first tab, the second tab, the third tab, and the fourth tab extend outwards from the body;

forming, in response to tension generated by the coupling of the first tab and the second tab, the coupling the third tab and the fourth tab, and the stretchable material of the body, a seal between at least the user's face and a guide edge disposed along a bottom edge of the grooming device such that the grooming device is secured in place, wherein the guide edge is a structured component comprised of a material that is more rigid than the stretchable material from which the body is formed, shaving portions of the face of the user exposed by the guide edge using the guide edge as a guide for a razor while performing the grooming operation; and preserving hair growth on a portion of the user's face covered by the guide edge and body.

11. The method of claim 10, further comprising: removing the grooming device after shaving the portions of the face of the user.

12. The method of claim 10, further comprising: preventing at least one of soap, shaving cream, or a gel from contacting the portion of the user's face covered by the guide edge and body based on the seal between at least the user's face and the guide edge.

13. The method of claim 10, further comprising: stretching the grooming device in response to coupling of the first tab and the second tab and coupling the third tab and the fourth tab to conform to a user's face.

14. The method of claim 10, wherein the guide edge inhibits movement of the grooming device subsequent to the removable coupling of the first tab and the second tab and the removable coupling of the third tab and the fourth tab.

15. The method of claim 10, wherein the body comprises an upper boundary and a lower boundary, wherein a center portion of the body extends from a center point of the upper boundary to the center point of the lower boundary, wherein the center portion comprises a contour in the stretchable material of the body, and wherein the center portion is configured to promote alignment of the center region with a center point on the chin of the user.

16. The method of claim 10, wherein the stretchable material and the material of the structured component are configured to elastically recover.

17. The method of claim 10, further comprising an material disposed on at least a portion of at least one side of the guide edge, wherein the material comprises at least one of: an adhesive material or a polymer material.

18. The method of claim 10, wherein the body is formed from a stretchable material configured in a first geometry when unassembled and configured in a second geometry when at least one of the first tab is engaged with the second tab or the third tab is engaged with the fourth tab.

19. The method of claim 10, wherein the guide edge extends on both the first side and the second side of the body along the portion of the bottom edge of the lower boundary, and wherein the guide edge is thicker than a thickness of the stretchable material from which the body is formed.

20. The method of claim 10, wherein the guide edge extends on both the first side and the second side of the body along the portion of the bottom edge of the grooming device, and wherein the guide edge is thicker than a thickness of the stretchable material from which the body is formed.

* * * * *